US005873261A

United States Patent [19]

Bae

[11] Patent Number: 5,873,261

[45] Date of Patent: Feb. 23, 1999

[54] ACCUMULATOR FOR ROTARY COMPRESSOR

[75] Inventor: Jeong-Yong Bae, Seoul, Rep. of Korea

[73] Assignee: LG Electronics Inc., Seoul, Rep. of Korea

[21] Appl. No.: 719,207

[22] Filed: Sep. 25, 1996

[30] Foreign Application Priority Data

Sep. 25, 1995 [KR] Rep. of Korea ..... 1995-31515

[51] Int. Cl.[6] ..... F25B 43/00

[52] U.S. Cl. ..... 62/503; 67/505; 67/83

[58] Field of Search ..... 62/83, 84, 85, 62/113, 324.4, 472, 503, 505, 513

[56] References Cited

U.S. PATENT DOCUMENTS

| | | | |
|---|---|---|---|
| 2,247,950 | 7/1941 | Kucher | 62/296 |
| 4,006,602 | 2/1977 | Fanberg | 62/505 X |
| 4,607,503 | 8/1986 | Fry | 62/503 |
| 4,611,473 | 9/1986 | Wada et al. | 62/503 |
| 4,888,962 | 12/1989 | Harper et al. | 62/503 |
| 5,507,151 | 4/1996 | Ring et al. | 62/296 X |
| 5,507,159 | 4/1996 | Cooksey | 62/503 |

*Primary Examiner*—Christopher Kilner

[57] ABSTRACT

Disclosed is an accumulator for a rotary compressor, the accumulator being formed with a lengthy L-tube, thus improving the efficiency of the compressor. The present invention includes a lengthy refrigerant transferring part formed around the outer circumference of the compressor to separate gaseous refrigerant from liquid refrigerant in the accumulator, and to send only the gaseous refrigerant into the cylinder; and a pipe fixing strip to fix the refrigerant transferring part to the compressor to prevent the movement of the refrigerant transferring part otherwise caused by the vibration and noise, thus improving the EER and the cooling capability of the compressor.

9 Claims, 5 Drawing Sheets

ACCUMULATOR FOR ROTARY COMPRESSOR

BACKGROUND OF THE INVENTION

1. Field of the Invention

The present invention relates to an accumulator for rotary compressor to the extension of the length of an accumulator for a rotary compressor and to a method of extending the length of an accumulator for a rotary compressor.

2. Description of the Conventional Art

FIGS. 1 to 3 show the structure of an accumulator in a conventional rotary compressor and its surrounding area.

A shell 2 defines the external appearance of the accumulator 1. A separator plate 3 the liquid refrigerant 10 flowing through a S-tube 12; which is installed inside the shell 2, from falling directly to the lower part of a accumulator 1. A screen 4 filters the impurities contained in the liquid refrigerant 10 flowing through the S-tube 12. A L-tube 5 separates the liquid refrigerant 10 from gaseous refrigerant 11, sending only the gaseous refrigerant 11 to a cylinder 8 through a suction compartment 16. An oil groove 6 formed at the L-tube 5 to allow oil 7 within the shell 2 to flow into a cylinder 8. A first fixing strip 9 is connected with a second fixing strip 13 formed at the compressor to fix the accumulator 1 to the compressor. This also allows a groove 15 formed at the second fixing strip to connect a projection 14 formed at the first fixing strip 9 with the second fixing strip 13 (see FIG. 3).

The operational motion of the above-described conventional rotary compressor's accumulator structured is described in the following:

As shown in the FIGS. 1 to 3, the liquid refrigerant 10 is introduced into the accumulator 1 through the S-tube 12 formed at the upper part of the accumulator 1.

In order to prevent the introduced liquid refrigerant 10 from falling directly down to the lower part of the accumulator 1, the separator plate 3 is provided. Separator plate 3 requires the liquid refrigerant 10 to pass through the separator plate 3 and then flow down to the lower part of the accumulator 1.

Impurities contained in the liquid refrigerant 10 are filtered through a screen 4. As such, the filtered liquid refrigerant 10 is accumulated inside the shell 2.

Oil 7 is introduced into a cylinder 8 after being sent to the L-tube 5 through the oil groove 6 formed at the L-tube 5.

The L-tube 5 separates the gaseous refrigerant 11 and the liquid refrigerant 10. Only the seperated gaseous refrigerant 11 is introduced into the accumulator 1.

When the length of the L-tube 5 is too short, the height of the oil surface of the liquid refrigerant 10 becomes higher than that of the L-tube 5, enabling the liquid refrigerant 10 to be introduced into the cylinder 8 and causing the reliability of the L-tube 5 to be diminished. Therefore, the length of the L-tube 5 should be extended to an appropriate height.

However, as shown in FIG. 2, the length of the L-tube 5 must be sufficiently short to fix the accumulator 1 on the rotary compressor and to sustain the weight of the accumulator 1. Therefore, as shown in the FIG. 3, only one first fixing strip 9 is used to fix and sustain the accumulator.

The accumulator 1 is fixed on the rotary compressor as follows:

A second fixing strip 13 is welded on the rotary compressor. Then after strip 13 is welded on the rotary compressor both projections 14 of the first fixing strip 9 are inserted into the grooves 15 formed on the second fixing strip 13. Thus, the accumulator 1 is fixed and sustained on the rotary compressor. The first fixing strip 9 also reduces vibration and noise deriving from the accumulator 1.

However, since the accumulator of the conventional rotary compressor improved efficiency based primarily on the diameter of the L-tube and the total internal volume (cubic volume) of the accumulator considerable improvement was not obtained in terms of the energy efficiency for the compressor. Thus, improvements in efficiency were made within the energy efficiency ratio of 0.1.

SUMMARY OF THE INVENTION

An object of the present invention is to provide an accumulator for a rotary compressor with the extended length of a L-tube capable of increasing the performance of a compressor and thereby increasing the efficiency of energy.

According to the present invention, the rotary compressor's accumulator comprises the following parts:

Refrigerant transferring means lengthly extended around the circumference of the compressor, to separate the liquid refrigerant and the gaseous refrigerant in the accumulator and to send only the gaseous refrigerant into a cylinder; and pipe fixing means fixing the refrigerant transferring means to the compressor, to prevent the movement of the refrigerant transferring means.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 6A is the spectrum of a frequency.

DETAILED DESCRIPTION OF THE INVENTION

Figure 1:
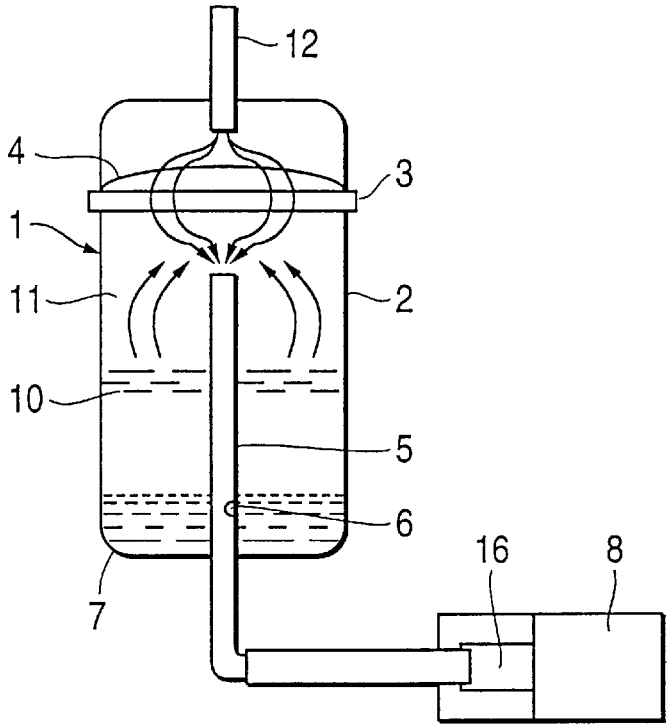
FIG. 1 (PRIOR ART)
FIG. 1 is a cross-sectional view of an accumulator's structure according to the conventional art.
Figure 2:
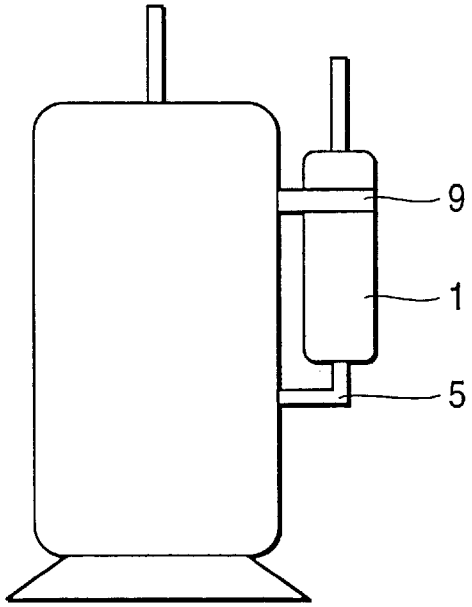
FIG. 2 (PRIOR ART)
FIG. 2 is the sustaining structure of an accumulator according to the conventional art.
Figure 3:
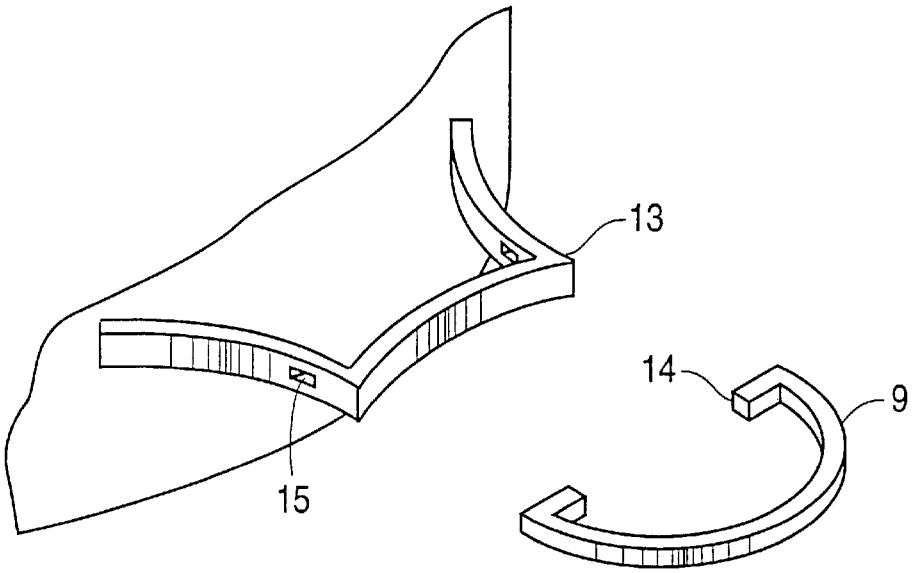
FIG. 3 (PRIOR ART)
FIG. 3 is the fixing strip's structure of an accumulator according to the conventional art.

As shown in the FIGS. 4 to 7, the accumulator for a rotary compressor according to the present invention includes an L-tube 102 functioning to separate the liquid refrigerant and the gaseous refrigerant in the accumulator 101, and to send only the gaseous refrigerant into a cylinder through the suction compartment 105; the first fixing strip 103 formed to fix and sustain the accumulator 101 on the compressor; and the pipe fixing strip 104 preventing the movement of the L-tube 102, and fixing and sustaining the L-tube on the rotary compressor.

As shown in the FIGS. 4 to 7, the operational motion and effectiveness of the rotary compressor's accumulator of the present invention are described hereinafter. This explanation is related with the wave-motion phenomenon at the suction part.

Figure 6A:
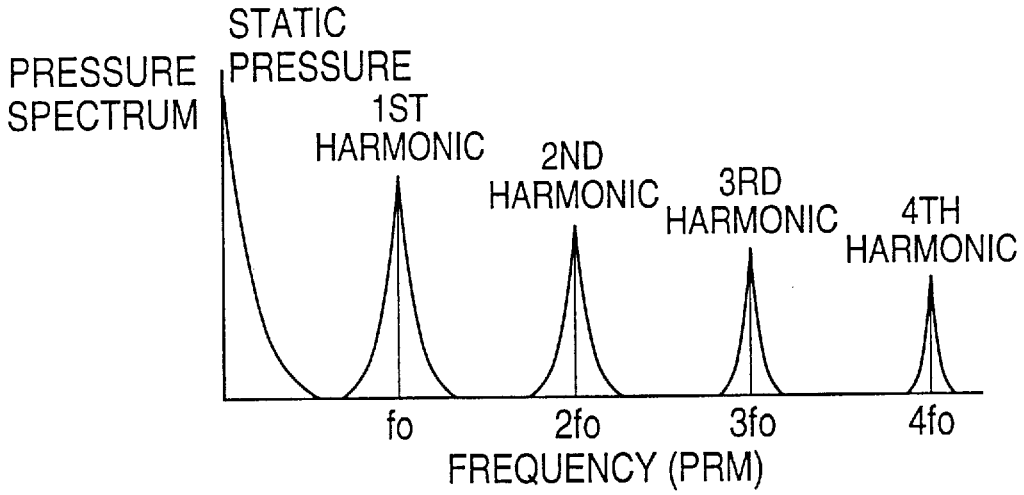
FIGS. 6A & B are a harmonic pressure corrugation of compressor movable frequency during the course of suction.
Figure 6B:
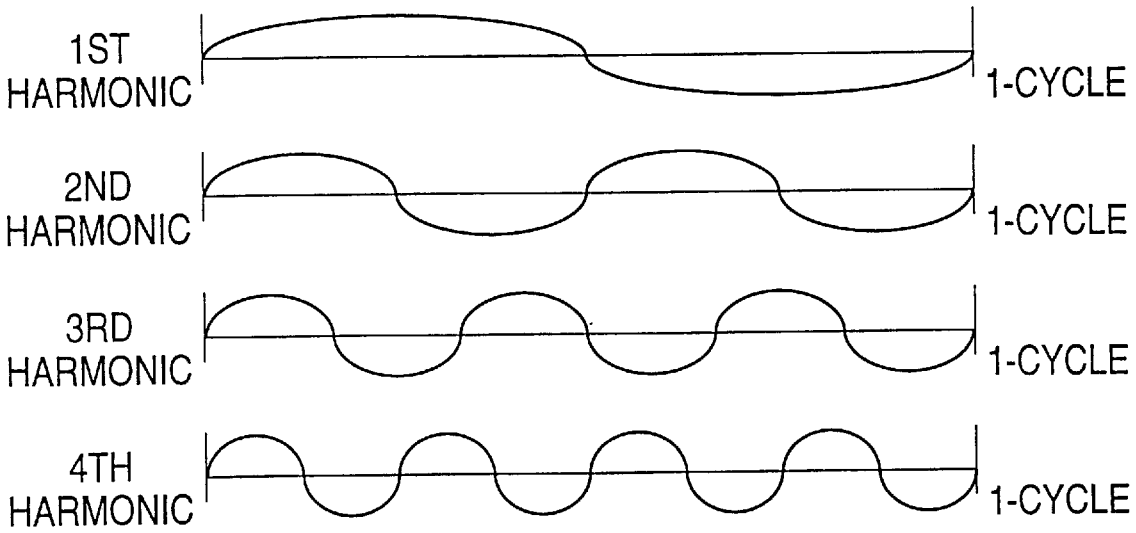
FIG. 6B is the spectrum of time.

As shown in FIG. 6, when suction starts, the suction pressure of the compressor reaches its peak at "n" times as high as the exciting frequency of, which represents the rotation frequency of the compressor that is equal to the driving frequency of the motor.

When n=o, static pressure becomes the main suction pressure of the compressor, and more than 90% of the entire suction of the compressor is generated as the static pressure. At this time, if one of the peak frequencies of n=1, 2, 3 is amplified, additional pressure can be obtained to improve the efficiency of the compressor.

Figure 5:
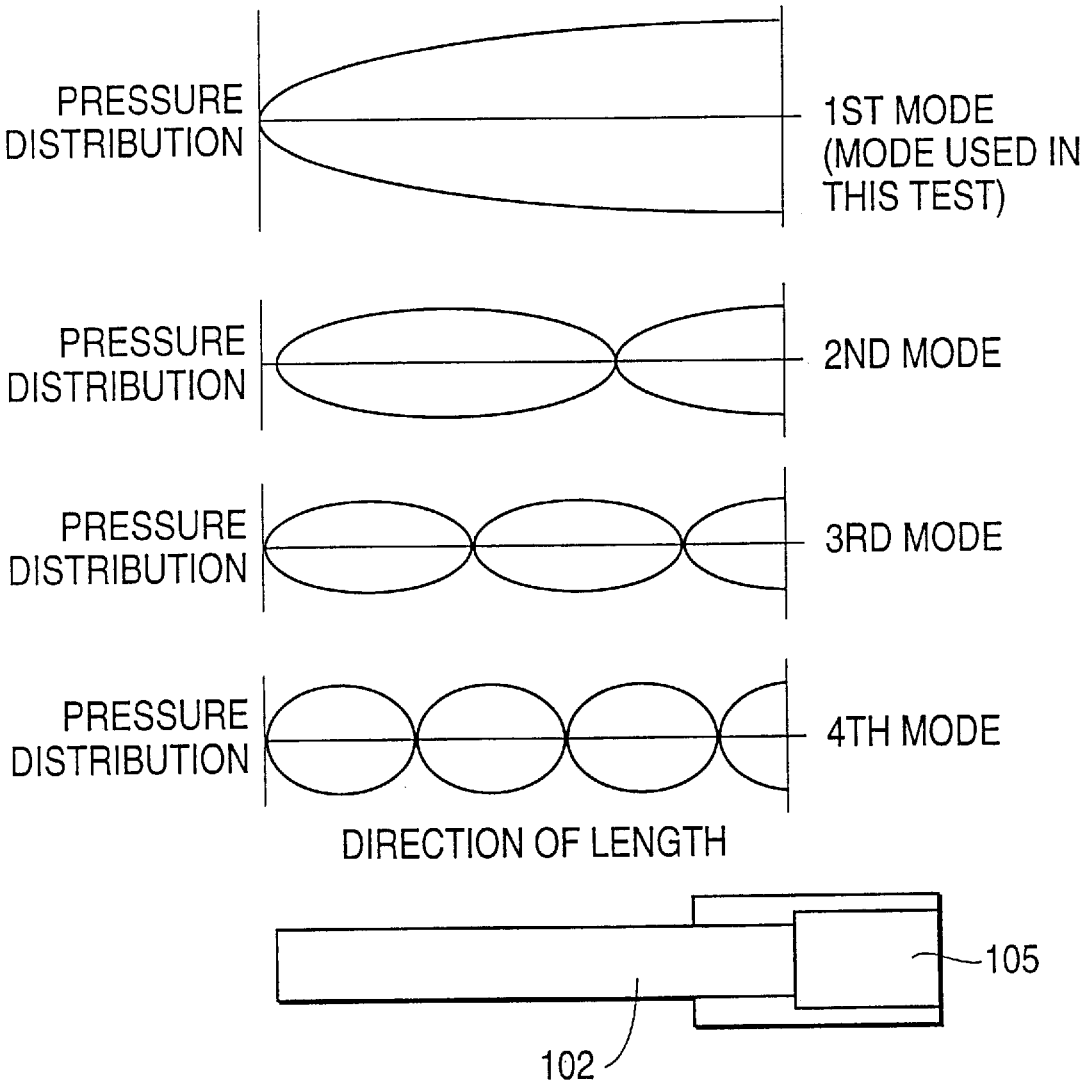
FIG. 5 is a pressure distribution chart at a resonant point within the L-tube of the accumulator according to the present invention.

The resonant frequency of the L-tube 102 in the accumulator 101 of the compressor is indicated as shown in FIG. 5, where the pressure of the suction compartment formed in the cylinder becomes stronger than the internal pressure of the accumulator 101.

When the Nth multiple of the exciting frequency of coincides with the resonant frequency of the L-tube, the wave-motion phenomenon is maximized, causing the suction pressure and the mass flow to increase.

The following formula relates the length L of the suction part, the exciting frequency of, and the exciting frequency multiple N to a tuning factor S, rendering the formula useful for tuning:

$$L \times N \times S = C/4fo, \qquad \text{Formula (1)}$$

where C represents the velocity of sound, N represents exciting frequency by n times, L represents the length of suction part, of represents the exciting frequency, and S represents a tuning factor.

Figure 7:
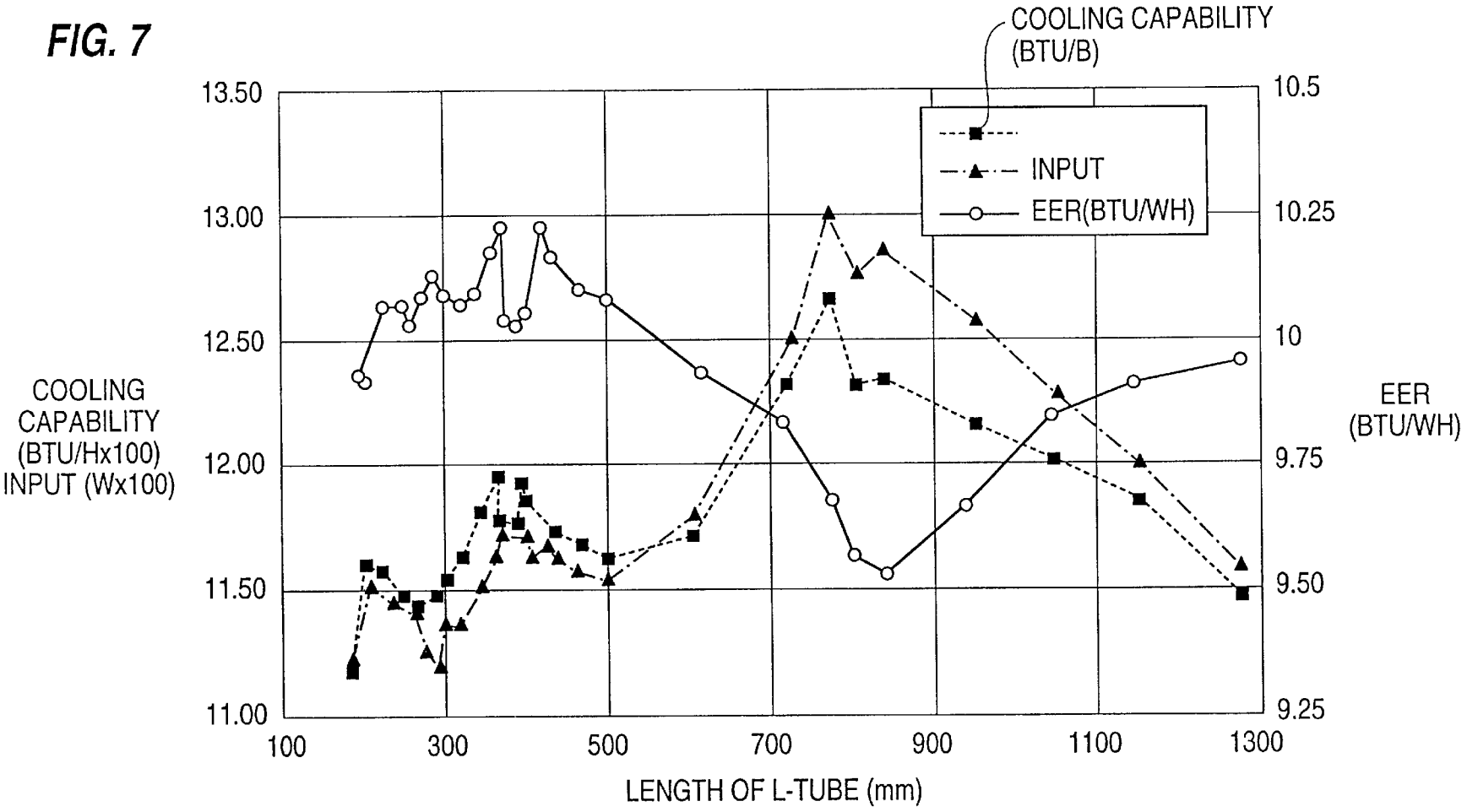
FIG. 7 shows the result of a compressor efficiency test for the length of the L-tube of the accumulator according to the present invention.

As indicated by equation (1) above, the tuned L-tube 102 creates a resonant phenomenon and thereby increases the cooling capability as shown in the FIG. 7. The length of L-tube 102 is tuned to provide the maximum range of the cooling capability when the L-tube is tuned with the first harmonic wave (n=1), and to provide the maximum range of the energy efficiency ratio (hereinbelow referred to as EER) of the energy when the L-tube is in the vicinity of the second harmonic wave (1.8of, 2.2of.) The resonant frequency and the length of the L-tube 102 are in inverse proportion.

The EER described above is not in the second harmonic wave, but is in the vicinity of that harmonic wave. This phenomenon is caused because, at the time of the resonance, the increase in pressure is higher than the increase of the EER.

When the accumulator 101 is fixed and sustained on the rotary compressor and is tuned using 1st and 2nd harmonic waves, the length of L-tube becomes longer.

Figure 4A:
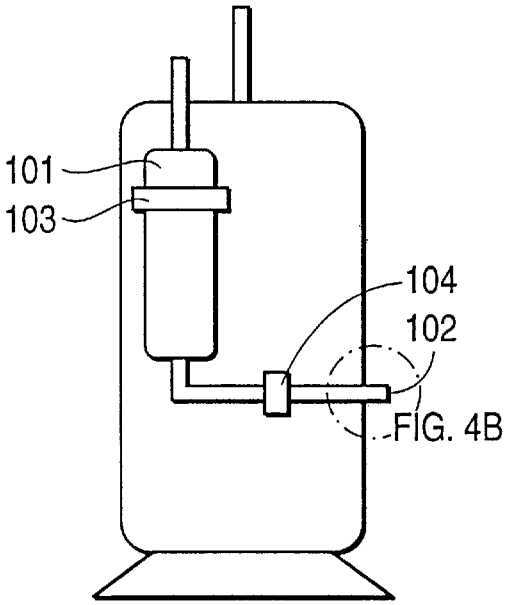
FIG. 4 is the sustaining structure of the accumulator according to the present invention.
Figure 4B:
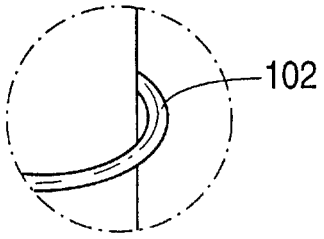

Therefore, the accumulator 101, as shown in the FIG. 4, is turned according to the circular shape on the circumference of the compressor, causing the L-tube 102 of the accumulator 101 to have a zigzag shape, when the accumulator 101 is fixed on the compressor with the fixing strip 103 as seen in the conventional system.

At this time, the length of the L-tube 102, formed around the circumference of the accumulator 101 in a zigzag shape, becomes longer, and the L-tube 102 may thus be moved by vibration and noise. Therefore, the L-tube 102 should be fixed on the compressor with the pipe fixing strip 104 as the accumulator 101 is fixed by the fixing strip 103.

Since the length of the L-tube 102 is long, the tube is occasionally inserted inside the accumulator 101 in a zigzag form, or established on an iron plate of an air conditioner instead of putting the tube on the compressor.

As it was explained above, with the extension of the length of the L-tube of the accumulator, the present invention increased the EER by 2.5% and the cooling capacity by 6.3% at the maximum point of the EER (n=2, s=0). When the cooling capacity is at its maximum point (n=1, s=1), the cooling capacity can be increased by up to 13%. Because of the improvement of the cooling capacity, the size of the compressor can be reduced and it can also reduce the frictional loss of the compressor, thus the efficiency of the compressor can be improved.

What is claimed is:

1. An accumulator for a rotary compressor, comprising:

refrigerant transferring means positioned around a portion of a circumference of the rotary compressor for separating gaseous refrigerant from liquid refrigerant in the accumulator and for sending only the gaseous refrigerant into the cylinder; and pipe fixing means fixing the refrigerant transferring means to the compressor for preventing movement of the refrigerant transferring means, wherein a length of the refrigerant transferring means is defined based on a rotational frequency of the rotary compressor.

2. The accumulator for the rotary compressor recited by claim 1, further comprising:

a suction compartment positioned between the refrigerant transferring means and the cylinder, wherein said refrigerant transferring means includes a tube for sending only the gaseous refrigerant into the cylinder from the accumulator through the suction compartment.

3. The accumulator for the rotary compressor recited by claim 2, wherein said pipe fixing means has a pipe fixing strip fixing the tube so as to prevent the tube from moving by vibration or noise.

4. The accumulator for the rotary compressor recited by claim 2, wherein said tube is inserted inside the accumulator with a curved form.

5. The accumulator for the rotary compressor recited by claim 3, wherein said pipe fixing strip is combined with the outer circumference of the compressor to reduce the vibration and noise caused by the accumulator.

6. A rotary compressor, comprising:

a closed container, a cylinder positioned within the closed container, a suction hole being defined in the cylinder enabling communication between an inside of the cylinder and an outside of the closed container, an accumulator positioned outside the closed container separating a suction refrigerant into liquid and gaseous refrigerant, a suction chamber positioned between the accumulator and the cylinder, a tube connecting the accumulator with the suction chamber and directing the gaseous refrigerant in the accumulator into the suction chamber, and pipe fixing means for fixing the tube and satisfying the expression give by:

$$1.8 \leqq \frac{c}{4Lf_o} \leqq 2.2,$$

wherein L represents a suction part length which is a length of a curved central portion of the tube extending from an inside end of the accumulator to the suction chamber, C represents an acoustic velocity of the refrigerant, and $f_o$ represents a rotational frequency of the rotary compressor.

7. The rotary compressor as recited in claim 6, wherein the accumulator has a curved form capable of accommodating greater than half the suction part length L.

8. A rotary compressor, comprising:

a closed contained, a cylinder positioned in the closed container, a suction hole being defined in the cylinder enabling communication between an inside of the cylinder and an outside of the closed container, an accumulator positioned outside the closed container separating a refrigerant into liquid and gaseous refrigerant, and a tube connecting the accumulator with a suction chamber so as to direct the gaseous refrigerant in the accumulator to the suction chamber, where a first resonant frequency of the rotary compressor is defined by the accumulator and the tube to be 1.8 to 2.2 times higher than a rotational frequency of the compressor.

9. The rotary compressor as recited in claim 8, wherein the accumulator includes:

at least two separate walls for dividing space within the accumulator, and a flux path structure disposed in the separate walls enabling communication between the divided spaces.

* * * * *